US010696517B2

(12) United States Patent
Toner et al.

(10) Patent No.: US 10,696,517 B2
(45) Date of Patent: Jun. 30, 2020

(54) ELEVATOR SECURITY AND CONTROL SYSTEM BASED ON PASSENGER MOVEMENT

(71) Applicant: OTIS ELEVATOR COMPANY, Farmington, CT (US)

(72) Inventors: Meghan Q. Toner, West Hartford, CT (US); Stephen K. Richmond, Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 371 days.

(21) Appl. No.: 15/529,334

(22) PCT Filed: Nov. 20, 2015

(86) PCT No.: PCT/US2015/061794

§ 371 (c)(1),
(2) Date: May 24, 2017

(87) PCT Pub. No.: WO2016/085795

PCT Pub. Date: Jun. 2, 2016

(65) Prior Publication Data

US 2017/0275134 A1 Sep. 28, 2017

Related U.S. Application Data

(60) Provisional application No. 62/084,693, filed on Nov. 26, 2014.

(51) Int. Cl.

| | |
|---|---|
| ***B66B 5/00*** | (2006.01) |
| ***B66B 5/02*** | (2006.01) |
| ***B66B 1/28*** | (2006.01) |

(52) U.S. Cl.

CPC ..... *B66B 5/0012* (2013.01); *B66B 1/28* (2013.01); *B66B 5/025* (2013.01)

(58) Field of Classification Search

CPC ..... B66B 5/0012; B66B 1/28; B66B 5/025

(Continued)

(56) References Cited

U.S. PATENT DOCUMENTS 4,839,631 A * 6/1989 Tsuji ..... G08B 13/00 187/392
5,519,669 A * 5/1996 Ross ..... G01S 15/02 340/541

(Continued)

FOREIGN PATENT DOCUMENTS

CN 1754815 A 4/2006
CN 101061049 A 10/2007

(Continued)

OTHER PUBLICATIONS

International Search Report for PCT/US2015/061794, dated Feb. 12, 2016, 3 pages.

(Continued)

*Primary Examiner* — David S Warren
(74) *Attorney, Agent, or Firm* — Cantor Colburn LLP

(57) ABSTRACT

An elevator security and control system for monitoring at least one of an elevator occupancy area and a landing area includes an elevator car and a passenger position sensor. The passenger position sensor monitors at least one of the occupancy area inside the elevator car and the landing area proximate to a passenger waiting area, and detects movement of at least one passenger located at one of the occupancy area and the landing area. The elevator security and control system further includes an electronic control module that detects at least one body part of the at least one passenger and controls operation of the elevator car based on at least one of a position and a movement of the at least one body part.

15 Claims, 4 Drawing Sheets

(58) Field of Classification Search
USPC ..... 187/247
See application file for complete search history.

(56) References Cited

U.S. PATENT DOCUMENTS 6,195,121 B1 * 2/2001 Huang ..... G06K 9/00228 348/144
6,614,348 B2 * 9/2003 Ciccolo ..... G08B 13/19613 340/541
6,967,674 B1 * 11/2005 Lausch ..... G06K 9/00771 348/143
7,088,846 B2 * 8/2006 Han ..... G06K 9/00335 382/103
7,127,083 B2 * 10/2006 Han ..... G06K 9/00295 382/103
7,136,507 B2 * 11/2006 Han ..... G06K 9/00335 382/103
7,310,442 B2 * 12/2007 Monachino ..... G06K 9/6293 348/169
7,369,680 B2 * 5/2008 Trajkovic ..... G06K 9/00335 340/540
7,804,426 B2 * 9/2010 Etcheson ..... G07C 5/008 340/937
7,822,227 B2 * 10/2010 Barnes ..... G01C 21/20 382/103
7,823,703 B2 * 11/2010 Amano ..... B66B 5/0012 187/247
7,823,704 B2 * 11/2010 Amano ..... B66B 5/0012 187/247
7,832,527 B2 * 11/2010 Amano ..... B66B 5/0012 187/392
7,837,013 B2 11/2010 Amano
8,363,900 B2 * 1/2013 Huang ..... H04N 5/144 382/103
8,373,567 B2 * 2/2013 Denson ..... G07C 5/008 340/576
RE44,225 E * 5/2013 Aviv ..... G06K 9/00771 348/152
RE44,527 E * 10/2013 Aviv ..... G06K 9/00771 348/152
8,589,174 B2 * 11/2013 Nelson ..... G06Q 50/22 705/2
8,684,142 B2 * 4/2014 Finschi ..... B66B 1/468 187/392
9,114,953 B2 * 8/2015 Mason ..... B66B 5/0012
9,317,741 B2 4/2016 Guigues et al.
9,382,096 B2 * 7/2016 Finschi ..... B66B 1/468
10,197,401 B1 * 2/2019 Hsu ..... B66B 3/006
10,207,893 B2 * 2/2019 Elomaa ..... B66B 1/2458
2002/0191819 A1 * 12/2002 Hashimoto ..... B66B 1/468 382/118
2003/0168288 A1 * 9/2003 Deplazes ..... H04N 7/18 187/317
2005/0138385 A1 * 6/2005 Friedli ..... B66B 1/468 713/182
2006/0037818 A1 * 2/2006 Deplazes ..... B66B 1/3476 187/392
2011/0213588 A1 9/2011 Lin et al.
2012/0160613 A1 * 6/2012 Friedli ..... B66B 5/0012 187/384
2013/0168191 A1 7/2013 Mason
2017/0275134 A1 * 9/2017 Toner ..... B66B 5/0012
2017/0369275 A1 * 12/2017 Saraswat ..... B66B 1/28
2018/0044132 A1 * 2/2018 Fauconnet ..... B66B 1/28
2018/0273345 A1 * 9/2018 Rao ..... B66B 1/468
2019/0002240 A1 * 1/2019 Xiong ..... B66B 5/0087
2019/0041221 A1 * 2/2019 Hsu ..... B66B 3/006
2019/0047819 A1 * 2/2019 Vaunois ..... B66B 5/16
2019/0177121 A1 * 6/2019 Shah ..... B66B 1/3476
2019/0218847 A1 * 7/2019 Agam ..... B66B 13/26
2019/0352134 A1 * 11/2019 Tscuppert ..... B66B 13/02

FOREIGN PATENT DOCUMENTS

CN 102241349 A 11/2011
CN 101571914 B 4/2012
CN 103434906 A 12/2013
CN 103708314 A 4/2014
CN 103130060 B 12/2015
CN 105347127 A 2/2016
CN 103183263 B 5/2016
CN 103733227 B 2/2017
EP 1809560 B1 4/2012
EP 2674913 A1 12/2013
FR 2985070 B1 8/2014
JP 2007031017 A2 2/2007
JP 2007091462 A 4/2007
JP 2007331925 A 12/2007
JP 2008230805 A 10/2008
JP 2009091052 A 4/2009
JP 2009110424 A 5/2009
JP 2012062165 A 3/2012
JP 2012134638 A 7/2012
JP 2012153452 A 8/2012
KR 20110042708 A 4/2011
WO 2016037651 A1 3/2016

OTHER PUBLICATIONS

Ansaldo STS SpA "Security for Railways and Metros" <URL: http://www.ansaldo-sts.com/sites/ansaldosts.message-asp.com/files/imce/security_eng.pdf> [retrieved Sep. 24, 2019] 5 pages.
Nogi et al., "Toward Human-oriented Transporation" Hitachi Review 58, No. 4 (2009) pp. 157-162.
Office Action for Chinese Application No. 201580064610.0; Application Filing Date Nov. 20, 2015; dated Aug. 23, 2018 (23 pages).

* cited by examiner

ELEVATOR SECURITY AND CONTROL SYSTEM BASED ON PASSENGER MOVEMENT

CROSS REFERENCE TO RELATED APPLICATIONS

This application is a National Stage application of International Patent Application Serial No. PCT/US2015/061794, filed Nov. 20, 2015, which claims benefit to U.S. Provisional Application No. 62/084,693, filed Nov. 26, 2014, which are incorporated herein by reference in their entirety.

TECHNICAL FIELD

This present disclosure relates generally to elevator control systems, and more particularly, to an elevator security and control system.

BACKGROUND

Conventional elevator systems include cameras that monitor the presence of passengers in an elevator car. However, traditional sensing technologies are typically limited to detecting passenger boarding/deboarding and elevator car occupancy. Traditional elevator operation, however, is not controlled according to the behavior of one or more passengers.

During operation of the elevator, emergency events, unauthorized actions by passengers, and/or confrontations between two or more passenger may occur which require security and/or emergency personnel to be alerted. Conventional elevator emergency systems, however, require that security staff manually monitor video feeds to detect unauthorized actions or emergency events. Moreover, once an unauthorized actions or emergency events, the security personnel must manually intervene by locating the elevator car during ride operation, manually disabling the elevator car from service and/or manually contacting emergency personnel. The conventional means for resolving unauthorized actions and/or emergency events is therefore time-consuming and inefficient.

SUMMARY

According to embodiment, an elevator security and control system for monitoring at least one of an elevator occupancy area and a landing area includes an elevator car and a passenger position sensor. The passenger position sensor monitors at least one of the occupancy area inside the elevator car and the landing area proximate to a passenger waiting area, and detects movement of at least one passenger located at one of the occupancy area and the landing area. The elevator security and control system further includes an electronic control module that detects at least one body part of the at least one passenger and controls operation of the elevator car based on at least one of a position and a movement of the at least one body part.

In addition to one or more of the features described above, or as an alternative, further embodiments include one or more of the following:

a feature, wherein the electronic control module determines a fixed area of interest located in the occupancy area and controls the elevator car based on a position of the at least one body part with respect to the fixed area of interest;

a feature, wherein the electronic control module determines a time period at which the at least one body part is positioned within the fixed area of interest and determines a security breach when the time period exceeds a time threshold;

a feature, wherein the electronic control module overrides operation of the elevator car in response to determining the security breach;

a feature, wherein the electronic control module distinguishes a first passenger located in at least one of the occupancy area and the landing area from a second passenger located in proximity to the first passenger;

a feature, wherein the electronic control module determines a security breach based on a position of a first body part of the first passenger with respect to a second body part of the second passenger;

a feature, wherein the electronic control module overrides operation of the elevator car in response to the security breach lasting greater than a time period threshold; and a feature, wherein the passenger position sensor includes a line of motion sensing input device that outputs data indicating a skeletal image of the at least one passenger, and wherein the electronic control module compares motion of the skeletal image to at least one anatomical model stored in memory to determine the movement of the at least one passenger.

According to another embodiment, a method of controlling an elevator system includes monitoring at least one of an occupancy area inside an elevator car and a landing area proximate to a passenger waiting area. The method further includes detecting movement of at least one passenger located in at least one of the occupancy area and the landing area. The method further includes determining at least one body part of the at least one passenger and controlling operation of the elevator car based on at least one of a position and a movement of the at least one body part.

In addition to one or more of the features described above, or as an alternative, further embodiments include one or more of the following:

determining a fixed area of interest located in the occupancy area and controls the elevator car based on a position of the at least one body part with respect to the fixed area of interest;

determining a time period at which the at least one body part is positioned within the fixed area of interest and determines a security breach when the time period exceeds a time threshold;

overriding operation of the elevator car in response to determining the security breach;

distinguishing a first passenger located in the occupancy area from a second passenger located in the occupancy area;

determining a security breach based on a position of a first body part of the first passenger with respect to a second body part of the second passenger; and overriding operation of the elevator car in response to the security breach lasting greater than a time period threshold.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Various non-limiting embodiments of the invention utilize motion tracking sensors such as, for example, video, radar, infrared, etc., to detect movements of one or more passengers. An electronic elevator control module can be programmed with software, anatomical models and/or motion algorithms that distinguish normal movements from abnormal movements and may determine that one or more security/emergency actions are necessary based on the abnormal movements. The security/emergency actions include, but are not limited to, alerting security/emergency personnel, cancelling an elevator call in order not to put passengers in an enclosed/unmonitored space for their safety and the safety of passengers standing by, generating an acoustic alert to notify the passengers of a security issue, and/or automatically overriding current elevator operations. An elevator car override can include, for example, returning the elevator car directly to the lobby or removing the elevator car from service by stopping at a next available floor or specific floor, and/or controlling operation of the elevator doors until the security/emergency event is resolved. In this manner, alerted security/emergency personnel can conveniently and quickly intervene and/or intercept one or more suspect passengers.

Figure 1:
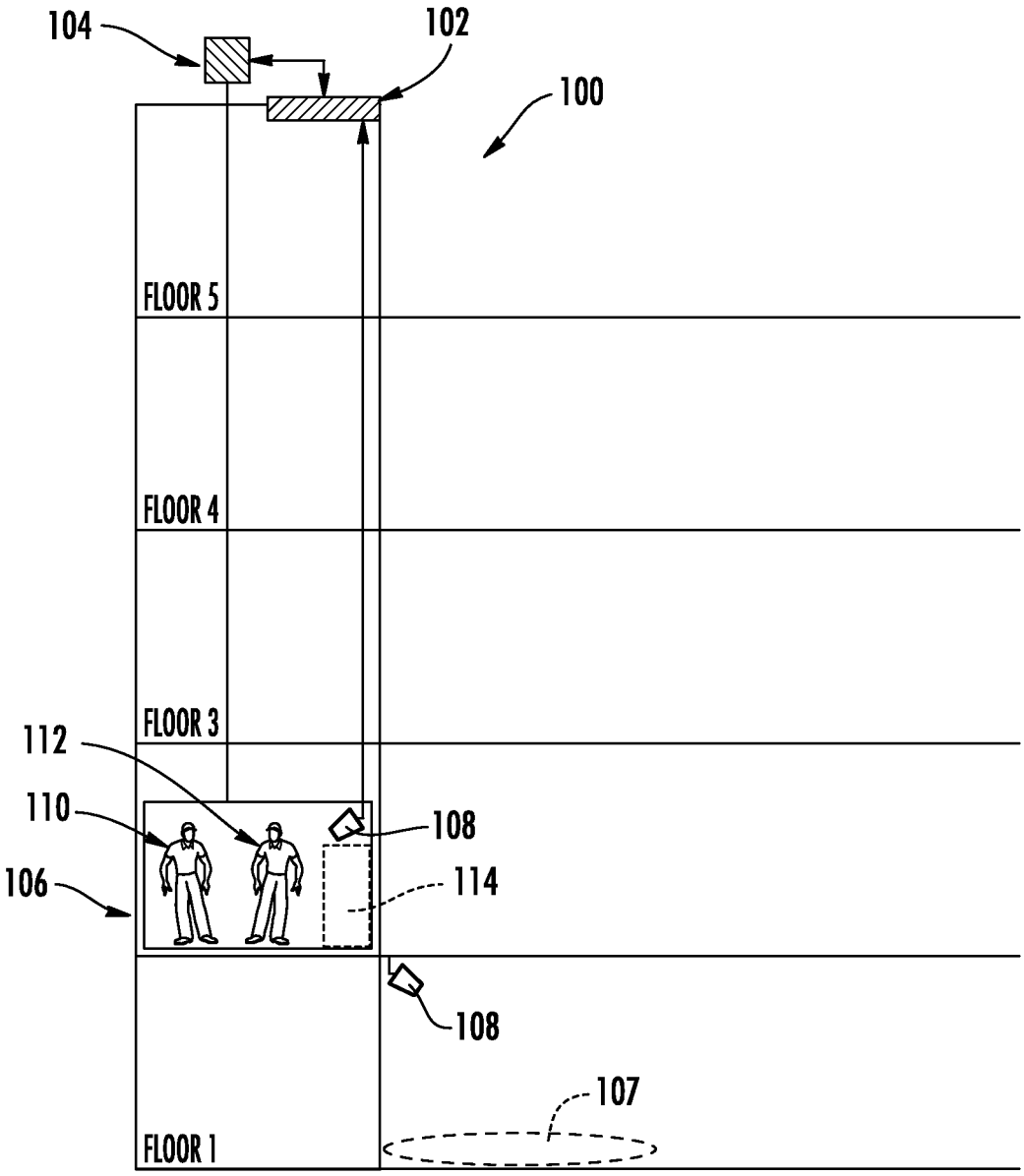
FIG. 1 is a block diagram illustrating an elevator security and control system according to a non-limiting embodiment.

Referring to FIG. 1, an elevator security and control system 100 is illustrated according to a non-limiting embodiment. The elevator security and control system 100 includes an electronic elevator control module 102, and an elevator car driving assembly 104. The elevator car driving assembly 104 includes a machine that imparts movement to elevator car 106 as understood by one of ordinary skill in the art. The elevator control module 102 includes an electronic microcontroller, for example, configured to output one or more electrical signals capable of controlling the operation of the elevator car driving assembly 104 and the elevator car 106 as understood by one of ordinary skill in the art.

The elevator security and control system 100 further includes one or more elevator car passenger sensors 108 in electrical communication with the elevator control module 102. Although a single elevator car passenger sensor 108 is shown, it is appreciated that a plurality of elevator car passenger sensor 108 may be utilized. The elevator car passenger sensor 108 is configured as a video camera coupled with a line of motion sensing input device, for example, that outputs an electrical signal to the elevator control module 102. In turn, the elevator control module 102 can process the output of the image sensor 108 to generate an image of the internal occupancy area of the elevator car 106 and any passengers 110-112 located in the occupancy area and/or an image of the area 107 proximate to the elevator car, e.g., the area where passengers are standing by in anticipation to board. According to an embodiment, the elevator control module 102 receives the output from the elevator car passenger sensor 108, and generates an image such as a three dimensional (3-D) image, for example, which can be tracked. For example, the elevator control module 102 can interpret specific gestures, movements and motions of one or more passengers. In addition, the elevator control module 102 can interpret the motion of a first passenger's body parts (e.g., hands, arms, legs, etc.) with respect to a particular region of the occupancy area and/or the body parts of other passengers 110-112 residing in the occupancy area, as discussed in greater detail below.

Figure 2C:
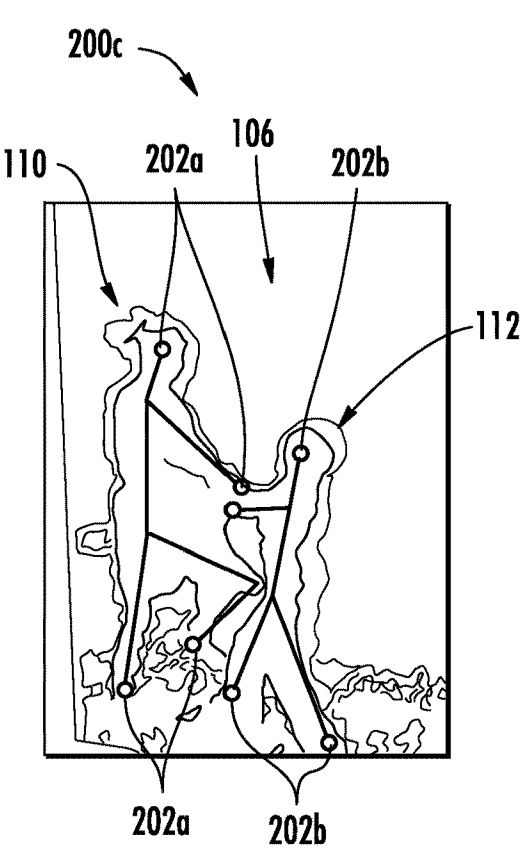
FIGS. 2A-2E illustrate images captured by an image sensor included and in turn analyzed by an electronic elevator control module included in an elevator security and control system according to a non-limiting embodiment.
Figure 2B:
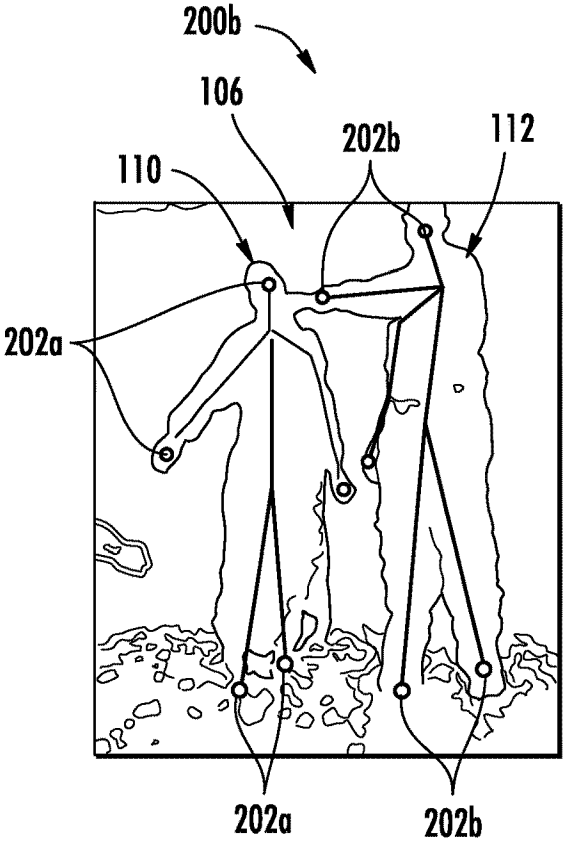
Figure 2A:
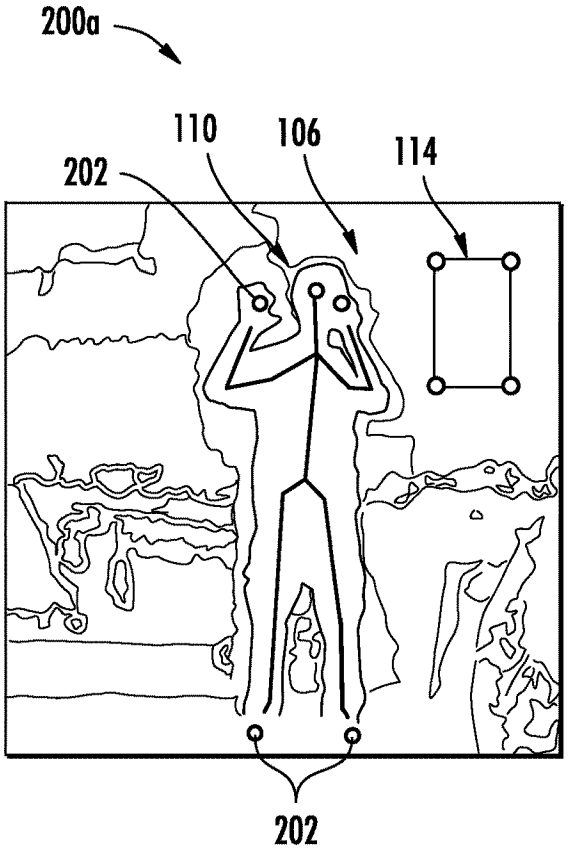

Turning to FIG. 2A, a 3-D image of an occupancy area within an elevator car 106 is illustrated according to a non-limiting embodiment. The 3-D image 200*a* is generated by the electronic elevator control module 102 based on an output of a line of motion sensing input device 108 installed within the elevator car 106. Although the occupancy area within the elevator car 106 is described going forward, it is appreciated that the 3-D image 200*a* can be of an area 107 located externally from the elevator car 106 without departing from the scope of the invention. The area located externally from the elevator car 106 can include, for example, a landing area 107 proximate an area where potential passengers standby waiting for the elevator car 106 to arrive at the elevator landing. The 3-D image 200*a* shows a first passenger 110 reconstructed as a moveable skeletal image, and a fixed area of interest 114. The skeletal image (e.g., 3-D image) of the first passenger 110 indicates one or more individual body parts 202 including, but not limited to, hands, arms, legs, feet, knees, elbows, and a head.

According to a non-limiting embodiment, the elevator control module 102 is configured to track and detect the motion and/or position of the individual body parts 202 with respect to the fixed area of interest 114 such as, for example, a secured area 114 to be accessed by authorized personnel only. Various depth sensors exist that provide full-body 3D motion capture, facial recognition as understood by one of ordinary skill in the art. For example, the depth sensor may include an infrared laser projector combined with a monochrome CMOS sensor, which captures video data in 3D under any ambient light conditions. The depth sensors may also be configured to adjust the sensing range of and automatically calibrate the sensor based on a person's physical environment. If a passenger's body part 202 (e.g., hand) enters the fixed area of interest 114, the electronic elevator control module 102 determines a security breach and executes one or more security measures. The security measures include, for example, generating a vocal alert in the occupancy area informing the passenger 110 that the current actions constitute a security breach and that continuing such action will result in notification of security personnel. When the passenger 110 removes the corresponding body part 202 from the area of interest 114 within the time threshold, the security breach alert is removed and the control module 102 operates the elevator car 106 as normal. When, however, the elevator control module 102 determines that the body part 202 has not been removed from the area of interest 114 within the time threshold following the vocal alert, the elevator control module 102 can take additional security measures including, for example, ceasing operation of the elevator car 106, notifying security personnel of the security breach, and moving the elevator car 106 to the lobby such that security personnel can conveniently confront the passenger 110.

Figure 3:
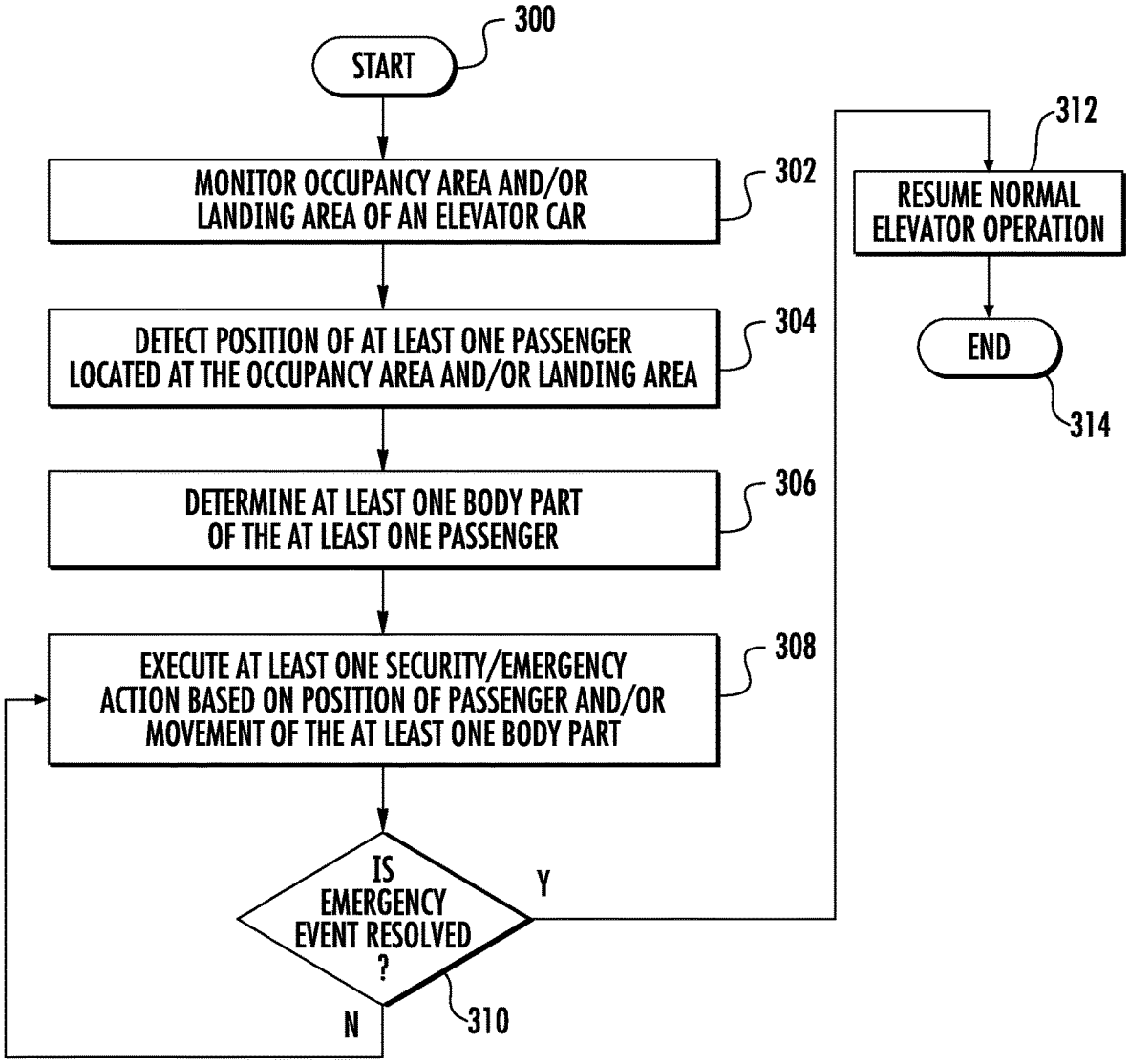
FIG. 3 is a flow diagram illustrating a method of controlling an elevator system according to a non-limiting embodiment.

Turning now to FIGS. 2B-2C, 3-D images 200*b*-200*c* show first and second passengers 110-112 located at occupancy area within an elevator car 106. According to a non-limiting embodiment, the elevator control module 102 is configured to track and detect the motion of the first passenger's 110 individual body parts 202 with respect to the motion of the second passenger's 112 individual body parts 202. The detection of one or more body parts 202*a*-202*b* include tracking the speed and movement of the body parts 202 to distinguish normal movements (e.g., normal standing, friendly conversation and interactions, and/or normal crowded car conditions) from abnormal movements (e.g., physical contact, fighting, pushing, aggressive movements, etc.). For example, the speed, motion and direction of a passenger's arm can be compared to one or more anatomical models (e.g., skeletal motion models) and/or algorithms (e.g., structure light algorithm, mean-shift algorithm, etc.) stored in the elevator control module 102 to determine whether a passenger's arm is moving in a punching motion. Various other abnormal acts such as, for example, jumping, climbing, rapid arm/leg movements, etc., can be determined based on a comparison of one or more body parts 202 with respect the one or more anatomical models (e.g., skeletal motion models) and/or algorithms (e.g., structure light algorithm. mean-shift algorithm, etc.).

When one or more passengers are located at area located externally from the elevator car 106, i.e., at the elevator landing area 107, the elevator control module 102 can still detect the movement and/or position of one or more passengers' body parts 202 as discussed above. When an emergency event and/or security event is detected in this case, the elevator control module 102 can execute various emergency and or security measures including, but not limited to, generating a vocal alert in the occupancy area informing the passengers 110-112 that the current actions constitute a security breach and that continuing such action will result in notification of security personnel, ceasing operation of the elevator car 106, and automatically notifying security/emergency personnel of the security/emergency event, According to a non-limiting embodiment, the elevator control module 102 is configured to track and detect the motion of one or more individual body parts 202*a* of a first passenger 110 with respect to the one or more body parts 202*b* of a second passenger 112. Turning to FIG. 2B, for example, the electronic elevator control module 102 detects that the body part 202*b* (i.e., hand/fist) of a second passenger 112 is in close proximity or contacts an body part 202*a* (i.e., head) of a first passenger 110. Accordingly, the elevator control module 102 determines a security breach exists and executes one or more security measures. The security measures include, for example, generating a vocal alert in the occupancy area informing the passengers 110-112 that the current actions constitute a security breach and that continuing such action will result in notification of security personnel. The elevator control module 102 can take additional security measures including, for example, ceasing operation of the elevator car 106, notifying security personnel of the security breach, and moving the elevator car 106 to a specific floor, e.g., the lobby, such that security personnel can conveniently confront one or more of the passengers 110-112.

Similarly, FIG. 2C illustrates a scenario where a physical altercation occurs between a first passenger 110 and a second passenger 112. According to a non-limiting embodiment, the electronic elevator control module 102 determines an apparent physical struggle between a first passenger 110 and a second passenger 112 based on the proximity and movements of the first passenger's body parts 202*a* and the second passengers body parts 202*b*. Accordingly, the elevator control module 102 determines a security breach exists and executes one or more security measures. The security measures include, for example, generating a vocal alert in the occupancy area informing the passengers 110-112 that the current actions constitute a security breach and that continuing such actions will result in notification of security personnel.

Figure 2D:
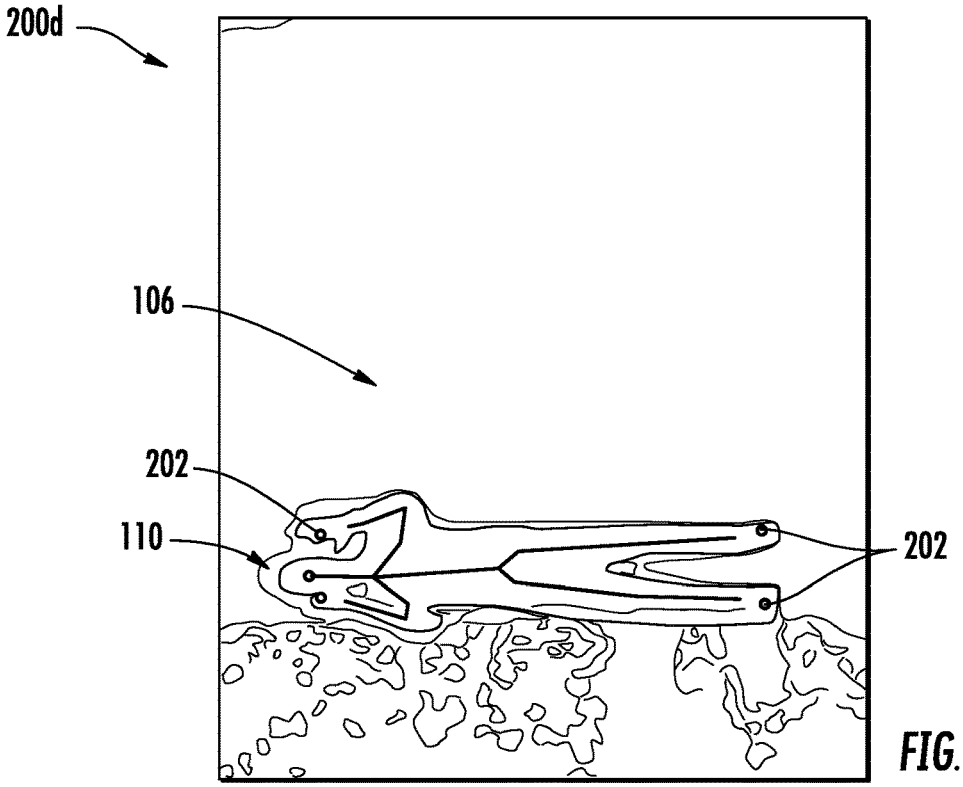

According to another embodiment illustrated in FIG. 2D, the electronic elevator control module 102 analyzes a 3-D image 200*d* and determines an emergency event in response to detecting a prone position of a first passenger 110 and determining the lack of movement among the first passenger's body parts 202. In response to determining the emergency event, the elevator control module 102 executes one or more emergency measures. The emergency measures include, for example, automatically contacting emergency personnel (e.g., automatically dialing 911), automatically delivering the elevator car 106 to the lobby and opening the doors, and/or removing the elevator car 106 containing the first passenger 110 from service. Although FIG. 2D shows the prone position of only the first passenger, it is appreciated that the elevator control module 102 may also determine the prone position and emergency event of the first passenger 110 following an altercation with one or more second passengers within the elevator car 106.

Figure 2E:
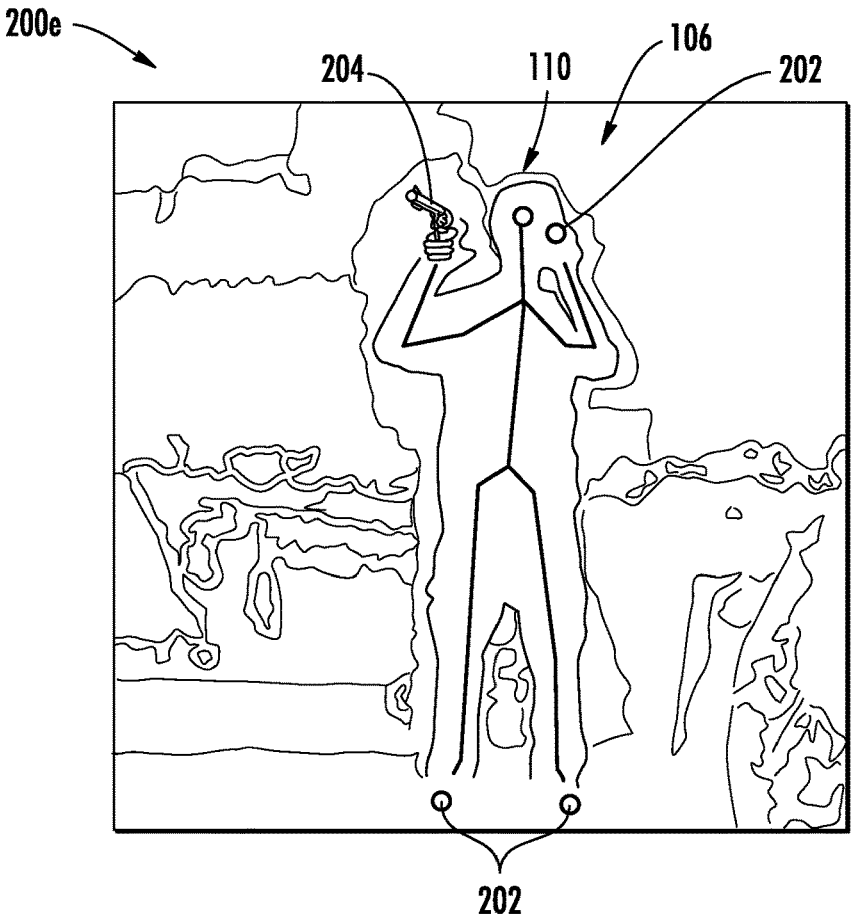

Turning to FIG. 2E, another embodiment is illustrated where the electronic elevator control module 102 analyzes a 3-D image 200*e* and determines that a first passenger 110 possess a weapon 204 such as, for example, a gun 204. In response to detecting the weapon 204, the elevator control module 102 determines a security breach exists and executes one or more security measures. The security measures include, for example, generating a vocal alert in the occupancy area informing the passengers 110-112 that the current actions constitute a security breach and that continuing such actions will result in notification of security personnel. Other security measures include, but are not limited to, ceasing operation of the elevator car 106, automatically notifying security personnel of the security breach (e.g., calling 911), and moving the elevator car 106 to a specific floor, e.g., the lobby, such that security personnel can conveniently confront one or more of the passengers 110-112, and/or removing the elevator from service such that passengers standing by for the elevator do not encounter the first passenger 110 possessing the weapon 204.

According to a non-limiting embodiment, when the passengers 110-112 stop the physical acts within the time threshold, the security breach alert is removed and the control module 102 operates the elevator car 106 as normal. When, however, the elevator control module 102 determines that the physical altercation has not stopped within the time threshold following the vocal alert, the elevator control module 102 can take additional security measures including, for example, ceasing operation of the elevator car 106, notifying security personnel of the security breach, and moving the elevator car 106 to the lobby such that security personnel can conveniently confront one or more of the passengers 110-112 as described above. In this manner, friendly acts or boisterous play can be distinguished from aggressive movements intended to inflict physical harm. As described above, the elevator control module 102 may also determine the prone position and emergency event of the first passenger 110 if the physical alteration ends with one or more passengers 110-112 motionless on the floor.

Turning now to FIG. 3, a flow diagram illustrates a method of controlling an elevator system according to a non-limiting embodiment. The method begins at operation 300 and at operation 302 an occupancy area of an elevator car and/or a landing area is monitored. At operation 304, the movement of at least one passenger located at the occupancy area and/or landing area is detected, and at least one body part of the at least one passenger is determined at operation 306. The movement and/or position of at least one passenger and a passenger's body parts can be determined using various cameras and depth sensors as described above. The movement can include a passenger's movement of a body part in proximity to an unauthorized area of the elevator, for example. According to another embodiment, the movement can include a physical confrontation between two or more passengers located in the occupancy area or the landing area. An unconscious or prone passenger located on the floor/ground can also be determined as discussed in detail above.

At operation 308, one or more emergency/security actions are executed based on the movement and/or position of one or more body parts of a passenger. For example, if a prone position of a first passenger is detected and the lack of movement among the first passenger's body is determined, the emergency/security event can include automatically contacting emergency personnel (e.g., automatically dialing 911), automatically delivering the elevator car to the lobby and opening the doors, and/or removing the elevator car containing the first passenger from service the method ends at operation. According to another embodiment, a physical altercation occurs between a first passenger and a second passenger. According to a non-limiting embodiment, a physical struggle between two or more passengers can be determined based on the proximity and movements of the passengers' body parts. Accordingly, one or more emergency/security measures can be executed in response to determining the altercation. The emergency/security measures include, but are not limited to, alerting security/emergency personnel, cancelling an elevator call, generating an acoustic alert to notify the passengers of a security issue, returning the elevator car directly to the lobby or removing the elevator car from service by stopping at a next available floor or specific floor, and controlling operation of the elevator doors until the security/emergency event is resolved. At operation 310, the system determines whether the emergency/security event has been resolved. If the emergency/security event has not been resolved, then the emergency/security action continues at operation 308. Otherwise, the emergency/security action is stopped such that the elevator system returns to normal operation at operation 312, and the method ends at operation 314.

As used herein, the term "module" refers to a hardware module including an Application Specific Integrated Circuit (ASIC), an electronic circuit, a processor (shared, dedicated, or group) and memory that execute one or more software or firmware programs, a combinational logic circuit, and/or other suitable components that provide the described functionality.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An elevator security and control system for monitoring at least one of an elevator occupancy area and a landing area, comprising:

an elevator car;

a passenger position sensor configured to generate a three-dimensional image of at least one of the occupancy area inside the elevator car and the landing area proximate to a passenger waiting area, configured to monitor at least one of the occupancy area inside the elevator car and the landing area proximate to a passenger waiting area, and to detect movement of at least one passenger located in at least one of the occupancy area and the landing area based on the three-dimensional image; and an electronic control module in communication with the passenger position sensor, the electronic control module configured to detect at least one body part of the at least one passenger based on the three-dimensional image and to execute at least one alert action based on at least one of a position and a movement of the at least one body part, wherein the electronic control module compares movement of at least one passenger to at least one anatomical model stored in memory to determine the movement of the at least one passenger.

2. The elevator security and control system of claim 1, wherein the electronic control module determines a fixed area of interest located in at least one of an occupancy area and a landing area, and controls the elevator car based on a position of the at least one body part with respect to the fixed area of interest.

3. The elevator security and control system of claim 2, wherein the electronic control module determines a time period at which the at least one body part is positioned within the fixed area of interest and determines a security breach when the time period exceeds a time threshold.

4. The elevator security and control system according to claim 3, wherein the electronic control module overrides operation of the elevator car in response to determining the security breach, and wherein the at least one alert action includes alerting one or both of security personnel and emergency personnel, cancelling an elevator call, generating an acoustic alert to notify the passengers of a security issue, returning the elevator car directly to the lobby or removing the elevator car from service by stopping at a next available floor or specific floor, and controlling operation of the elevator doors until the alert event is resolved.

5. The elevator security and control system of claim 1, wherein the electronic control module distinguishes a first passenger located in at least one of the occupancy area and the landing area from a second passenger located in proximity to the first passenger.

6. The elevator security and control system of claim 5, wherein the electronic control module determines a security breach based on a position of a first body part of the first passenger with respect to a second body part of the second passenger.

7. The elevator security and control system of claim 6, wherein the electronic control module overrides operation of the elevator car in response to the security breach lasting greater than a time period threshold.

8. The elevator security and control system of claim 1, wherein the passenger position sensor includes a line of motion sensing input device that outputs data indicating a skeletal image of the at least one passenger, and wherein the electronic control module compares motion of the skeletal image to at least one anatomical model stored in memory to determine the movement of the at least one passenger.

9. A method of controlling an elevator system, the method comprising:

monitoring, via a passenger position sensor including a line of motion sensing input device, at least one of an occupancy area inside an elevator car and a landing area proximate to a passenger waiting area;

outputting data, the via passenger position sensor, that indicates a skeletal image of at least one passenger, and detecting movement of the at least one passenger located in at least one of the occupancy area and the landing area based on the skeletal image;

analyzing, via a control module, movement of at least one passenger to at least one anatomical model stored in memory to determine the movement of the at least one passenger to determine at least one body part of the at least one passenger;

comparing, via the control module, the movement of at least one passenger to at least one anatomical model stored in memory to determine the movement of the at least one passenger to at least one anatomical model stored in memory to determine the movement of the at least one passenger; and executing at least one alert action based on the movement of the at least one passenger and the comparison between the at least one body part and the at least one anatomical model.

10. The method of claim 9, further comprising determining a fixed area of interest located in the occupancy area and controls the elevator car based on a position of the at least one body part with respect to the fixed area of interest.

11. The method of claim 10, further comprising determining a time period at which the at least one body part is positioned within the fixed area of interest and determines a security breach when the time period exceeds a time threshold.

12. The method according to claim 11, further comprising overriding operation of the elevator car in response to determining the security breach, and wherein the at least one alert action includes alerting alert personnel, cancelling an elevator call, generating an acoustic alert to notify the passengers of a security issue, returning the elevator car directly to the lobby or removing the elevator car from service by stopping at a next available floor or specific floor, and controlling operation of the elevator doors until the alert event is resolved.

13. The method of claim 9, further comprising distinguishing a first passenger located in at least one of the occupancy area and the landing area from a second passenger located in the occupancy area.

14. The method of claim 13, further comprising determining a security breach based on a position of a first body part of the first passenger with respect to a second body part of the second passenger.

15. The method of claim 14, further comprising overriding operation of the elevator car in response to the security breach lasting greater than a time period threshold.

* * * * *